United States Patent [19]

Denz

[11] Patent Number: 4,924,835

[45] Date of Patent: May 15, 1990

[54] METHOD OF AND DEVICE FOR THE ELECTRONIC DETERMINATION OF THE FUEL AMOUNT FOR AN INTERNAL COMBUSTION ENGINE

[75] Inventor: Helmut Denz, Stuttgart, Fed. Rep. of Germany

[73] Assignee: Robert Bosch GmbH, Stuttgart, Fed. Rep. of Germany

[21] Appl. No.: 214,738

[22] PCT Filed: Jun. 6, 1987

[86] PCT No.: PCT/DE87/00263

§ 371 Date: Mar. 28, 1988

§ 102(e) Date: Mar. 28, 1988

[87] PCT Pub. No.: WO88/02811

PCT Pub. Date: Apr. 21, 1988

[30] Foreign Application Priority Data

Oct. 10, 1986 [DE] Fed. Rep. of Germany ..... 3634551

[51] Int. Cl.[5] ..... F02M 51/00

[52] U.S. Cl. ..... 123/478

[58] Field of Search ..... 123/478, 480

[56] References Cited

U.S. PATENT DOCUMENTS 4,051,818 10/1977 Völckers ..... 123/478

FOREIGN PATENT DOCUMENTS 2455482 5/1976 Fed. Rep. of Germany ..... 123/478

*Primary Examiner*—Raymond A. Nelli

*Attorney, Agent, or Firm*—Michael J. Striker

[57] ABSTRACT

A method of eliminating an interfering a.c. component of a fuel injection control signal of an electronically controlled internal combustion engine, in which a injeciton duration control signal $t_L$ is computed and generated in an electronic control unit in dependency on various engine variables, such as engine speed, engine load, etc. The control signal $t_L$ which may contain an interfering a.c. component is filtered in a filter whose damping effect is variable as a function of predetermined values of at least one engine variable.

8 Claims, 4 Drawing Sheets

METHOD OF AND DEVICE FOR THE ELECTRONIC DETERMINATION OF THE FUEL AMOUNT FOR AN INTERNAL COMBUSTION ENGINE

BACKGROUND OF THE INVENTION

Because of increasingly stringent legal requirements on the maximum allowable toxic content of the exhaust gas of internal combustion engines, but also from the standpoint of improving the ride in motor vehicles, electronic control units are used with increasing frequency for controlling various engine parameters. For instance, it is known to calculate the fuel requirement electronically from the aspirated air quantity or air flow rate, or from the pressure in the intake tube and the engine speed, and then to trigger an injection apparatus with a corresponding trigger signal. In full-load operation, however, the intake strokes sometimes cause such major pulsations of the air quantity flow rate signal and hence of the load signal, which may be in the form of an injection duration or a fuel quantity signal, that the mixture composition fluctuates, which is disruptive and causes increased toxic emissions. In engine idling, and in particular in overrunning or engine braking in the idling speed range, the phase displacement between the air quantity or engine speed detection, the injection instant and the torque output also becomes preceptable and is often disruptive. Rough engine idling, and engine "bucking" in overrunning, are the result.

German Patent Disclosure Document DE-OS 24 55 482 describes an arrangement for obtaining signals from which trigger signals for the fuel metering are generated in an electronic control unit. The signals serving as input signals for the control unit and relating to engine speed and aspirated air flow rate are supplied to a rectifier having a low-pass filter characteristic, in order to damp any alternating voltage components that may be present and that can arise from factors external to the operation. Since the low-pass filter characteristic of the rectifier remains fixed, or in other words is not adapted to changing engine states, the arrangement does not always function completely satisfactorily. Above all, when there are sudden load changes, filter-dictated delays in fuel metering occur.

SUMMARY OF THE INVENTION

It is the object of an invention to provide a method with which the above-mentioned effect of filter devices can be reduced, if not eliminated completely. This and other objects are attained by means a method for eliminating interfering a.c. components from a fuel injection control signal by means of computing and generating a basic injection duration control signal in dependency on predetermined engine variables such as engine speed, airflow rate, etc., and filtering the basic injection duration control signal by a filter whose damping characteristics for the a.c. components is changed in response to predetermined values of at least one engine variable.

ADVANTAGES OF THE INVENTION

The method according to the invention has the advantage over the known prior art that a filter of variable characteristic is used. A further advantage is that it is not the input signals of the control unit, but rather the output signals calculated from them, that are filtered. A further advantage is that in steady or quasi-steady operation of the engine, the damping characteristic of the filter is derived from a field of characteristics of an at least two-dimensional performance graph, by means of which the damping effect of the filter can be adapted to the momentary operating range of the engine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
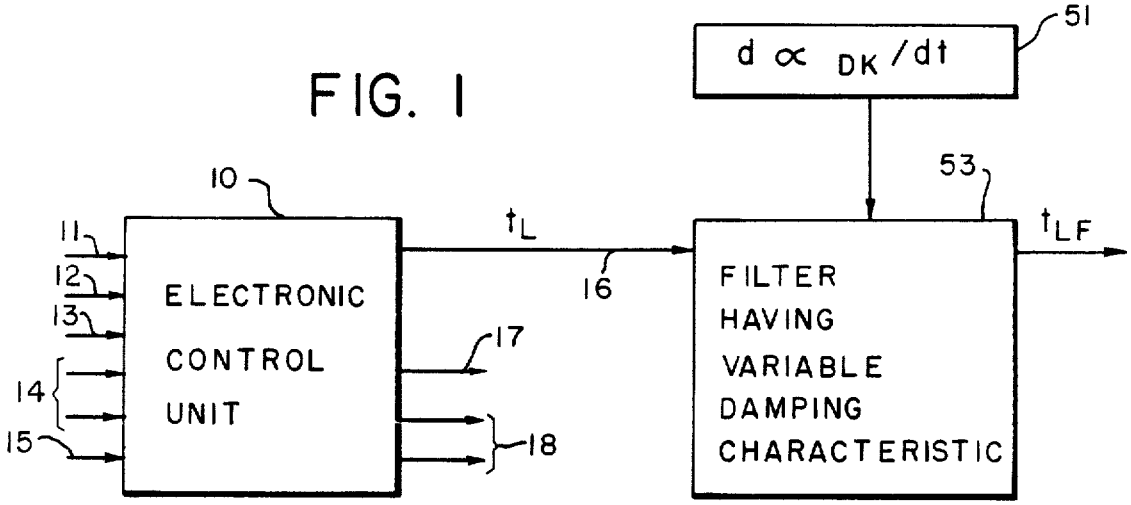
FIG. 1 is a block diagram of a device for carrying out an embodiment of the method of the invention.

FIG. 1 shows an electronic control unit 10, to which a number of input variables is supplied. Reference numeral 11 represents the signal of a throttle valve position transducer, and reference numeral 12 indicates the signal of an air flow rate sensor (in the ensuing description, the terms "air flow rate" and "air quantity" are used synonymously, because it is known to one skilled in the art to calculate the air mass, or flow rate, from the air quantity), which may be a hot-wire air flow rate sensor, a sensor operating on the baffle valve, or a pressure sensor. An engine speed signal n is supplied via the input 13, and reference numeral 14 indicates further signals, such as an engine temperature signal, fuel temperature signal, knocking signal and lambda sensor signal. Via 15, a signal $V_{FZ}$ proportional to the speed of the vehicle reaches the control unit.

In the control unit 10, a great number of output signals are calculated from the input signals and generated. Reference numeral 16 indicates an output for signals $t_L$ controlling the actuation of fuel injection valves; reference numeral 17 is an output for ignition pulses, and reference numeral 18 indicates the outputs for further signals.

The signal $t_L$ which may be subject to interfering pulsations, is applied to a filter 53 having a damping characteristic which in this example is dependent on air flow rate defined by the time derivative of the angular position of the throttle valve. The time derivative $d\alpha_{DK}/dt$ is generated in a differentiator 51 which is supplied with the signal of a throttle valve position transducer.

Figure 2:
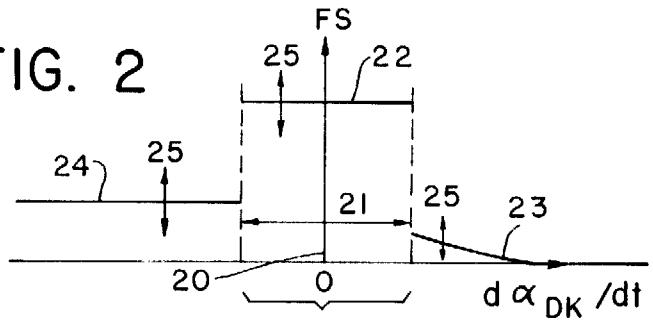
FIG. 2 is a graph showing a variable damping characteristic of the filter in the device of FIG. 1.

In the diagram of FIG. 2, the time derivative the throttle valve position transducer signal is plotted on the abscissa and the filter damping characteristic FC is plotted on the ordinate. Located about the zero point 20 is an insensitivity zone 21, within which a a high damping characteristic FC 22 of the filter 53 set for an a.c. component of the injection duration control signal. This zone is adjoined, for positive values of $d\alpha_{DK}/dt$, by a variable low damping characteristic FC 23, and for negative values of $d\alpha_{DK}/dt$ by a constant low damping characteristic FC 24. FIG. 2 provides the following information for the operation of the engine:

At slight fluctuations in the throttle valve position $\alpha_{DK}$, such as occur in full-load operation, the throttle valve position transducer signal remains within the insensitivity zone 21. In that case, the fuel metering signal $t_L$ is filtered by means of a strongly damping filter having the characteristic FC 22. In most cases, the fuel metering control signal corresponds to an injection duration that is then likewise averaged. By means of the filtering, the disruptive intake stroke effects are eliminated. If the throttle valve opens suddenly (positive $d\alpha_{DK}/dt$), damping of the a.c. component of the fuel metering signal is no longer desired, because that would necessarily cause damping of acceleration. In that case, a sloping, relatively low-damping characteristic FC 23 dependent on $d\alpha_{DK}/dt$ is selected. In FIG. 2, the sloping characteristic FC 23 indicates linear dependency of the filter signal on $d\alpha_{DK}/dt$; however other dependency can be also selected. Optimal solutions should be ascertained by trial and error on a case-by-case basis. For sudden closure of the throttle valve, corresponding to a negative value of $d\alpha_{DK}/dt$, a constant, relatively low damping characteristic FC 24 is selected, the value of which is less than the value of characteristic FC 22 and greater than the variable value of characteristic FC 23. By means of such changes of the damping characteristic, the prior art problems described before can be compensated for. The double arrows 25 indicate that the filter characteristics can also depend on the operating parameters of the engine, such as the engine temperature.

Figure 3:
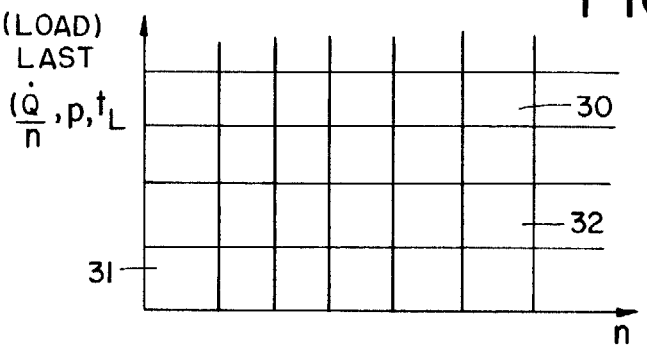
FIG. 3 shows an engine performance graph for determining various damping characteristics of a filter.

FIG. 3 shows another embodiment of the method using a predetermined field of damping characteristics for the case where a throttle valve position transducer is not provided. The engine speed n is plotted on the abscissa and a load signal (such as basic injection duration $t_L$, pressure P in the intake tube, aspirated air flow rate Q with respect to engine speed n, fuel quantity) is plotted on the ordinate. Other parameters are also possible. Dividing each of the axes into five zones furnishes a net that is already sufficiently fine for selecting damping characteristics of the filter as a function of the operating state of the engine. Here reference numeral 30 indicates a full load, reference numeral 32 a partial load, and reference numeral 31 an idling state. The method then functions as follows:

Depending upon the momentary operating state, the most favorable filter effect for this state is ascertained in a device for determining the damping characteristic from the performance graph of FIG. 3, and with it the load signal that represents the basic injection duration $t_L$ is filtered.

Figure 4:
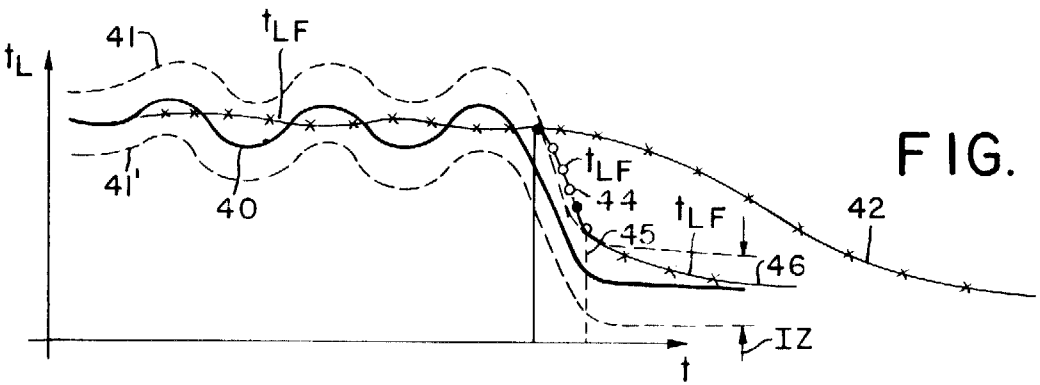
FIG. 4 is a time plot of an injection duration control signal filtered by a modified method of the invention.

From FIG. 4, a further possibility for performing the method is apparent. The time t is plotted on the abscissa and the amplitude of an injection duration signal $t_L$ that represents the quantity of fuel to be injected is plotted on the ordinate. The solid line 40 represents the interfering a.c. component of the basic injection duration control signal $t_L$, and the broken lines 41 and 41' define tolerance one IZ located about line 40. At time 43, a sudden load change takes place, causing a sharply declined course of the curve 46 of the control signal $t_L$. Reference numeral 42 indicates the course of the filtered control signal $t_{LF}$ produced from the curve 40. At time 43, this course 42, because of the changed damping effect of the filter 53, starts deviate from the declining curve 46 with a steadily increasing deviation, and intersects the curve 41 defining the upper limit of a tolerance zone IZ for the amplitude of the a.c. component. Departure from the zone IZ leads to a switchover of the damping characteristic FC of the filter, resulting in a filtered control signal course corresponding to the curve 44. If the curve 44 intersects the boundary of the zone IZ, at point 45, then a switchover back to the strongly damping filter characteristic FC 22 is effected, resulting in the constant course represented by the end portion of the curve 46.

Figure 5:
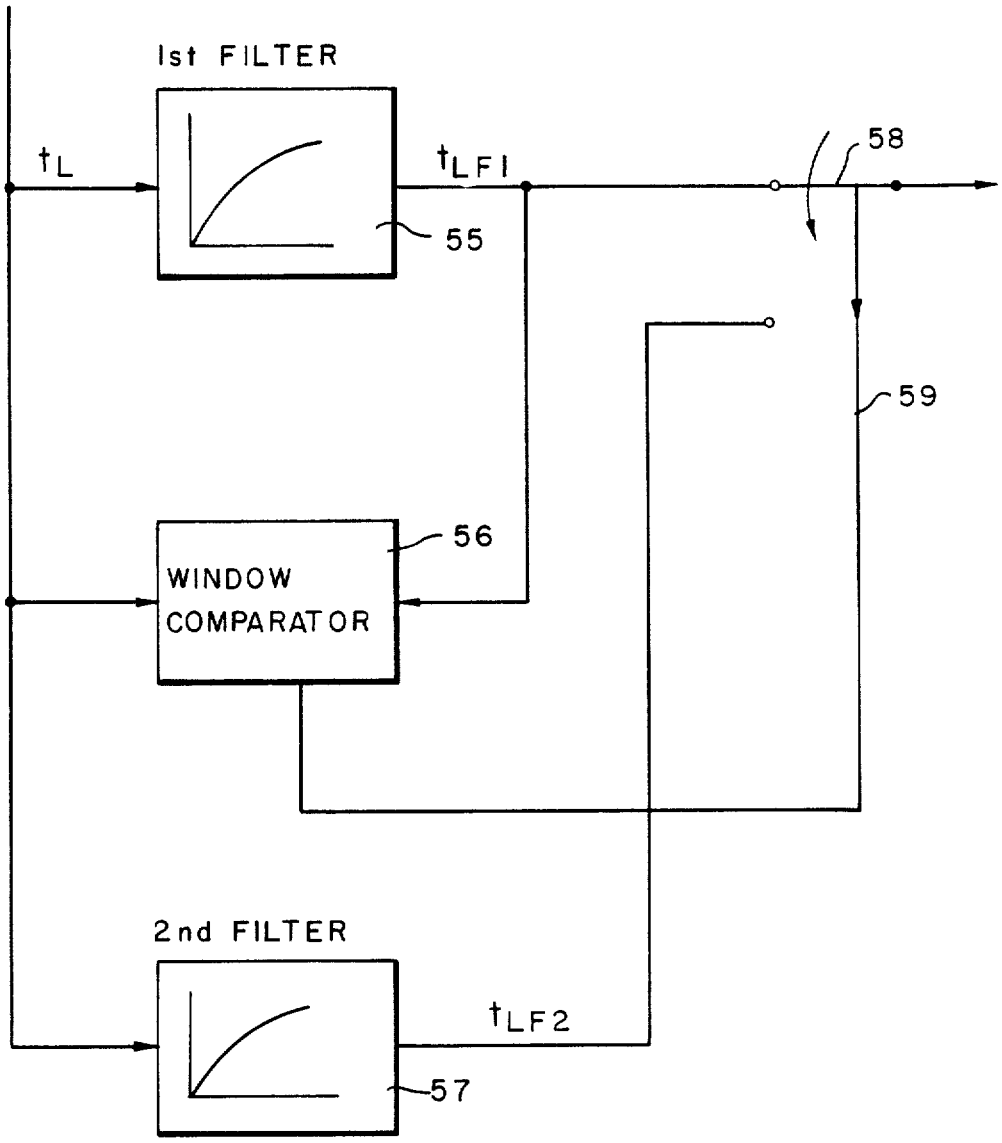
FIG. 5 is a block diagram of a device for carrying out the modified method of FIG. 4.

FIG. 5 is a block circuit diagram for the device, in which the method of FIG. 4 for adapting the filter characteristic to the load of the engine is carried out. The load dependent injection duration control signal $t_L$ is simultaneously supplied to the first filter 55, a window comparator 56 and a second filter 57. As a function of the output signals of the first filter 55 and the second filter 57, the window comparator controls the position of the switch 58, as indicated by line 59. The switch 58 connects either the output of first filter 55 or the output of the second filter 57 with amplifier devices, not shown, which then emit the filtered control signals for actuating the fuel metering elements. When the first filter 55 is supplied with the fuel quantity control signal $t_L$, the filtered signal $t_{LF1}$ is then available at the output of the filter. In the window comparator 56, a check is performed as to whether the filtered output signal $t_{LF1}$ is inside or outside the zone IZ(FIG. 4).

Figure 6:
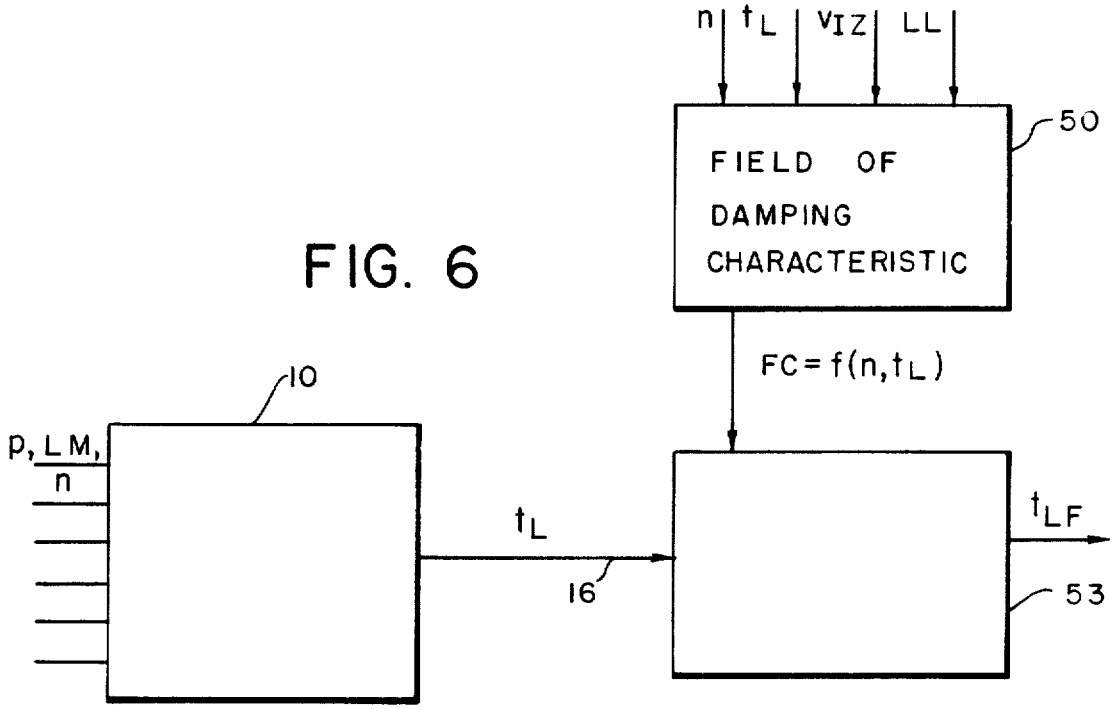
FIG. 6 is a block diagram of a device for carrying out another modification of the method of the invention.
Figure 7:
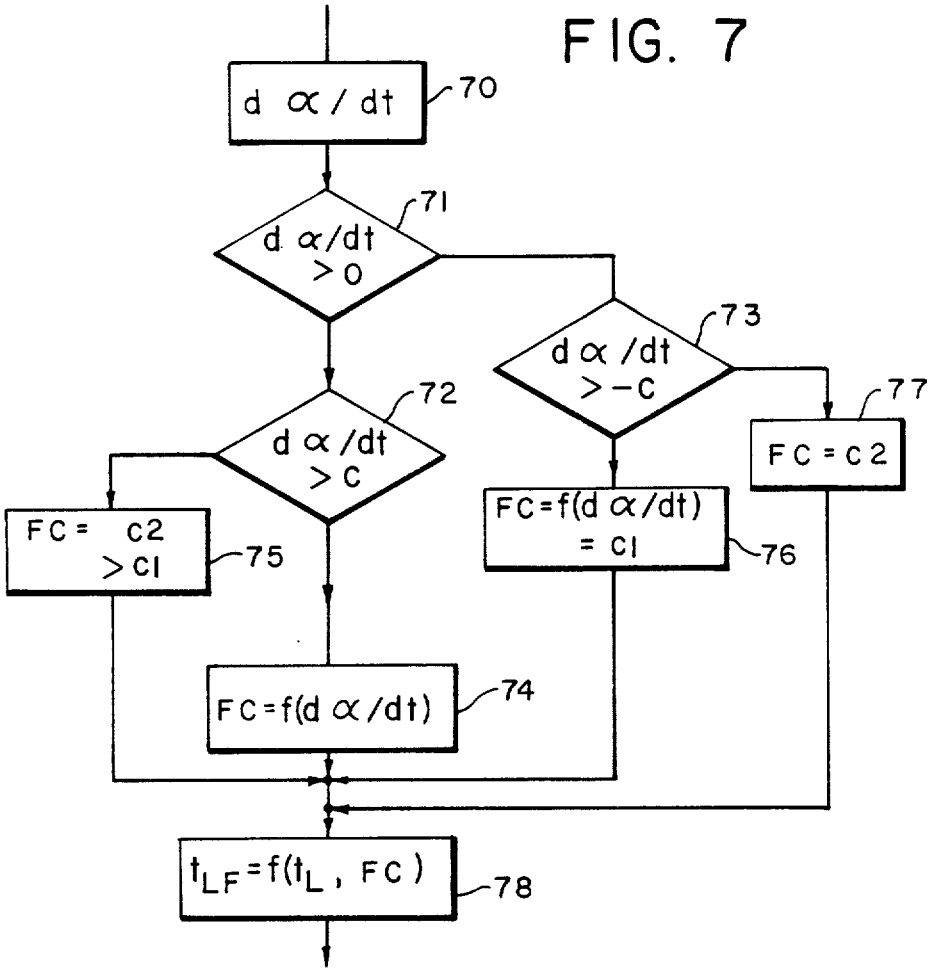
FIG. 7 is a flow chart of a program for controlling the operation of the device of FIG. 1.
Figure 7A:
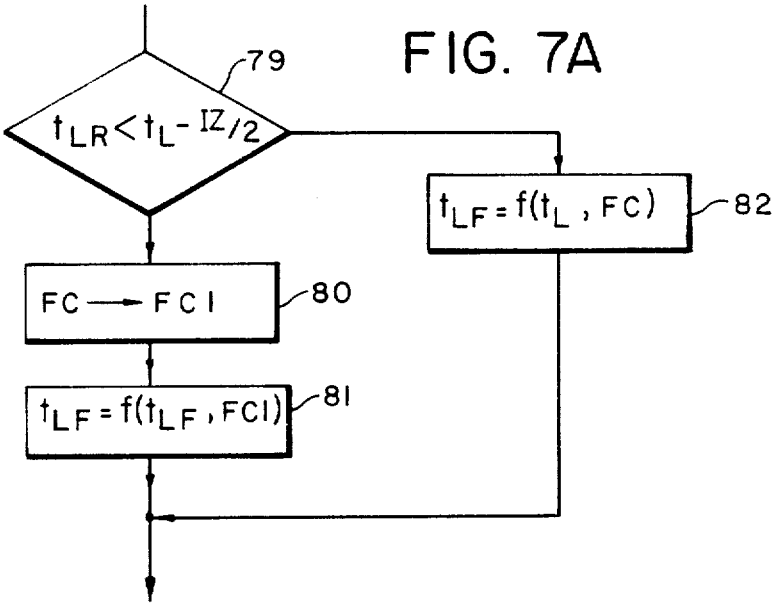
FIG. 7A is a flow chart of a program for controlling the operation of the device of FIG. 5.

If it is inside the zone IZ, the comparator 56 sets a position of the switch 58 that connects the output of the first filter 55 with amplifier means, not shown. If it is ascertained that the filtered signal $t_{LF1}$ is leaving the insensitivity zone, the switch 58 is connected to the output of the second filter 57. Such an instance occurs upon major load changes. The second filter 57 becomes operative, as FIG. 4 shows, at the instant associated with point 43. FIG. 6 shows a block diagram of a device similar to that of FIG. 1 but using a field of damping characteristics (or the engine performance graph of FIG. 3) for determining the damping effect FC of the filter 53 in dependency on predetermined engine variables, in the example of FIG. 3 on engine speed n and engine load. The flow chart of FIG. 7 is directed to the arrangement of FIG. 1. In block 70, the first time derivative $d\alpha_{DK}/dt$ is formed from the throttle valve position transducer signal. In block 71, it is decided whether the derivative is greater than or less than 0. If the derivative is greater than 0, the program proceeds to block 72; if it is smaller than 0, the program branches to block 73. In the decision block 72, a check is made as to whether the derivative is greater than a positive constant C. If so, then in block 74 a filter characteristic FC dependent on the magnitude of the derivative is selected. If it is less than the positive constant C, in block 75 a filter constant C2 is selected such that it is greater than a filter constant C1. If in the decision block 71 the derivative is less than or equal to 0, then in decision block 73 a check is made as to whether the derivative is less than a specific lower threshold −C. If so, then in block 76 a filter characteristic FC greater than C1 is determined as a function of the magnitude of the derivative. If the derivative is greater than the lower threshold $-C$, then in block 77 a filter characteristic FC of magnitude C2 is determined. The program reaches the same point from blocks 74, 75, 76 and 77, and is continued in block 78. In block 78, as a function of the basic injection time $t_L$ and the filter characteristic FC ascertained in the preceding program course, a filtered injection time $t_{LF}$ is ascertained. The flow chart of FIG. 7A is directed to the arrangement of FIG. 5. In the decision block 79, a check is made as to whether the injection duration control signal $t_L$ is below or above the zone IZ located about the a.c. component of the signal $t_L$. If the signal $t_L$ is outside the zone IZ, then in block 80 a varied filter characteristic FC is ascertained from the previously applicable filter characteristic FC. This varied filter characteristic is generally obtained in a filter of lower damping capacity. From this varied filter characteristic, in block 81, a new injection time signal $t_{LF}$ is formed. If the time signal $t_{LF}$ was not outside the zone IZ, then in block 82 the most recently ascertained value of this injection time is retained and supplied to the amplifier means.

I claim:

1. A method of eliminating interfering a.c. components from a fuel injection control signal of an electronically controlled internal combustion engine, comprising the steps of computing and generating a basic fuel quantity control signal in dependency on predetermined engine variables such as engine speed, air flow rate and the like, and filtering said basic control signal by a filter whose damping characteristic for the a.c. component is changed in response to predetermined values of at least one engine variable to produce a filtered fuel quantity control signal.

2. A method as defined in claim 1 wherein said basic fuel quantity control signal is an injection duration control signal.

3. A method as defined in claim 2 wherein said injection duration control signal is computed in dependency on engine load.

4. A method as defined in claim 1 wherein the damping characteristic is changed in response to the rate of change of the engine load.

5. A method as defined in claim 2 wherein the damping characteristic is changed in response to the rate of change of the amplitude of the injection duration control signal.

6. A method as defined in claim 1 wherein the dependency of the damping characteristic on predetermined values of at least two engine variables is predetermined and stored in an engine performance graph.

7. A method as defined in claim 3 wherein for a steady or quasi-steady engine load a relatively high damping characteristic is set which is constant over a predetermined load range; for a suddenly decreasing load a lower damping characteristic is set which is constant over a predetermined load range; and for a suddenly increasing load a lower damping characteristic is set which decreases with increasing load.

8. A method as defined in claim 5 wherein for a steady or quasi-steady engine load a relatively high damping characteristic is set while for a sudden change of the load when the filtered injection duration signal exceeds a predetermined tolerance range of the a.c. component, a low damping characteristic is set.

* * * * *